US011118407B2

(12) United States Patent
Deolalikar et al.

(10) Patent No.: US 11,118,407 B2
(45) Date of Patent: Sep. 14, 2021

(54) MUD OPERATED ROTARY STEERABLE SYSTEM WITH ROLLING HOUSING

(71) Applicant: HALLIBURTON ENERGY SERVICES, INC., Houston, TX (US)

(72) Inventors: Neelesh V. Deolalikar, Houston, TX (US); Daniel M. Winslow, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 73 days.

(21) Appl. No.: 16/605,125

(22) PCT Filed: May 15, 2017

(86) PCT No.: PCT/US2017/032755
§ 371 (c)(1),
(2) Date: Oct. 14, 2019

(87) PCT Pub. No.: WO2018/212754
PCT Pub. Date: Nov. 22, 2018

(65) Prior Publication Data

US 2021/0140241 A1 May 13, 2021

(51) Int. Cl.
*E21B 7/06* (2006.01)

(52) U.S. Cl.
CPC ..... *E21B 7/062* (2013.01); *E21B 7/068* (2013.01)

(58) Field of Classification Search
CPC ..... E21B 7/062; E21B 7/068
See application file for complete search history.

(56) References Cited

U.S. PATENT DOCUMENTS 4,114,702 A 9/1978 Maurer et al.
4,416,339 A 11/1983 Baker et al.
5,009,273 A 4/1991 Grabinski
(Continued)

FOREIGN PATENT DOCUMENTS

EP 1008717 A1 6/2000
WO 2017065724 A1 4/2017

OTHER PUBLICATIONS

International Search Report and Written Opinion dated Dec. 14, 2017 for PCT Application No. PCT/US2017/032755 filed May 15, 2017, (13 pages).

*Primary Examiner* — Taras P Bemko
(74) *Attorney, Agent, or Firm* — Chamberlain Hrdlicka

(57) ABSTRACT

A directional drilling device for drilling a borehole having a borehole wall, the device including an outer housing and a driveshaft selectively rotatable with respect to the housing and including an axial flow bore and a through port formed in the driveshaft wall. The device also includes one or more borehole engagement members rotatable with and radially moveable with respect to the outer housing toward engagement with the borehole wall to urge the directional drilling device in a radial direction with respect to the borehole. The device further includes a mud pressure actuation system. The mud pressure actuation system controls fluid flow through the through port to control hydraulic pressure on a piston device and thus movement of the borehole engagement members into engagement with the borehole wall to maintain a rotational position of the outer housing and the corresponding radial direction in which the device is being urged.

20 Claims, 5 Drawing Sheets

(56) References Cited

U.S. PATENT DOCUMENTS

| | | | | |
|---|---|---|---|---|
| 5,201,375 | A | 4/1993 | Base et al. | |
| 5,467,834 | A | 11/1995 | Hughes et al. | |
| 5,735,357 | A | 4/1998 | Palm | |
| 6,059,661 | A | 5/2000 | Simpson | |
| 6,158,529 | A | 12/2000 | Dorel | |
| 6,439,325 | B1 | 8/2002 | Peters et al. | |
| 6,561,290 | B2 | 5/2003 | Blair et al. | |
| 6,595,303 | B2 | 7/2003 | Noe et al. | |
| 6,609,579 | B2 | 8/2003 | Krueger et al. | |
| 7,556,105 | B2 | 7/2009 | Krueger | |
| 8,011,452 | B2 | 9/2011 | Downton | |
| 8,376,067 | B2 | 2/2013 | Downton et al. | |
| 9,016,400 | B2 | 4/2015 | Clausen et al. | |
| 9,016,401 | B2 | 4/2015 | Savage et al. | |
| 2011/0120725 | A1* | 5/2011 | Downton | E21B 4/06 166/373 |
| 2012/0177308 | A1 | 7/2012 | Marchand | |
| 2014/0014413 | A1 | 1/2014 | Niina et al. | |
| 2014/0262507 | A1 | 9/2014 | Marson et al. | |
| 2015/0090497 | A1 | 4/2015 | Marson et al. | |
| 2018/0080283 | A1* | 3/2018 | Wang | E21B 7/064 |
| 2018/0252088 | A1* | 9/2018 | Tilley | E21B 47/024 |

* cited by examiner

MUD OPERATED ROTARY STEERABLE SYSTEM WITH ROLLING HOUSING

BACKGROUND

Directional drilling is used to control the direction in which boreholea borehole is drilled, to guide the borehole along a desired trajectory to a target destination. Examples of directional drilling systems include point-the-bit rotary steerable drilling systems and push-the-bit rotary steerable drilling systems. In a point-the-bit system, the drilling direction is typically changed by tilting the angle of the drill bit during drilling to point to bit in the desired direction. In a push-the-bit system, the drilling direction is typically changed by offsetting the drill bit from the center of the boreholeborehole, for example, by pushing extendable pads that exert a force against the boreholeborehole wall to push the bit the desired direction.

BRIEF DESCRIPTION OF THE DRAWINGS

For a detailed description of the embodiments of the invention, reference will now be made to the accompanying drawings in which.

DETAILED DESCRIPTION

The present disclosure provides methods and systems for directional drilling. Specifically, the present disclosure provides a directional drilling system, such as a rotary steerable system (RSS) in drilling fluid pressure is utilized to control the position and rotation of the housing of a mud operated RSS tool.

Figure 1:
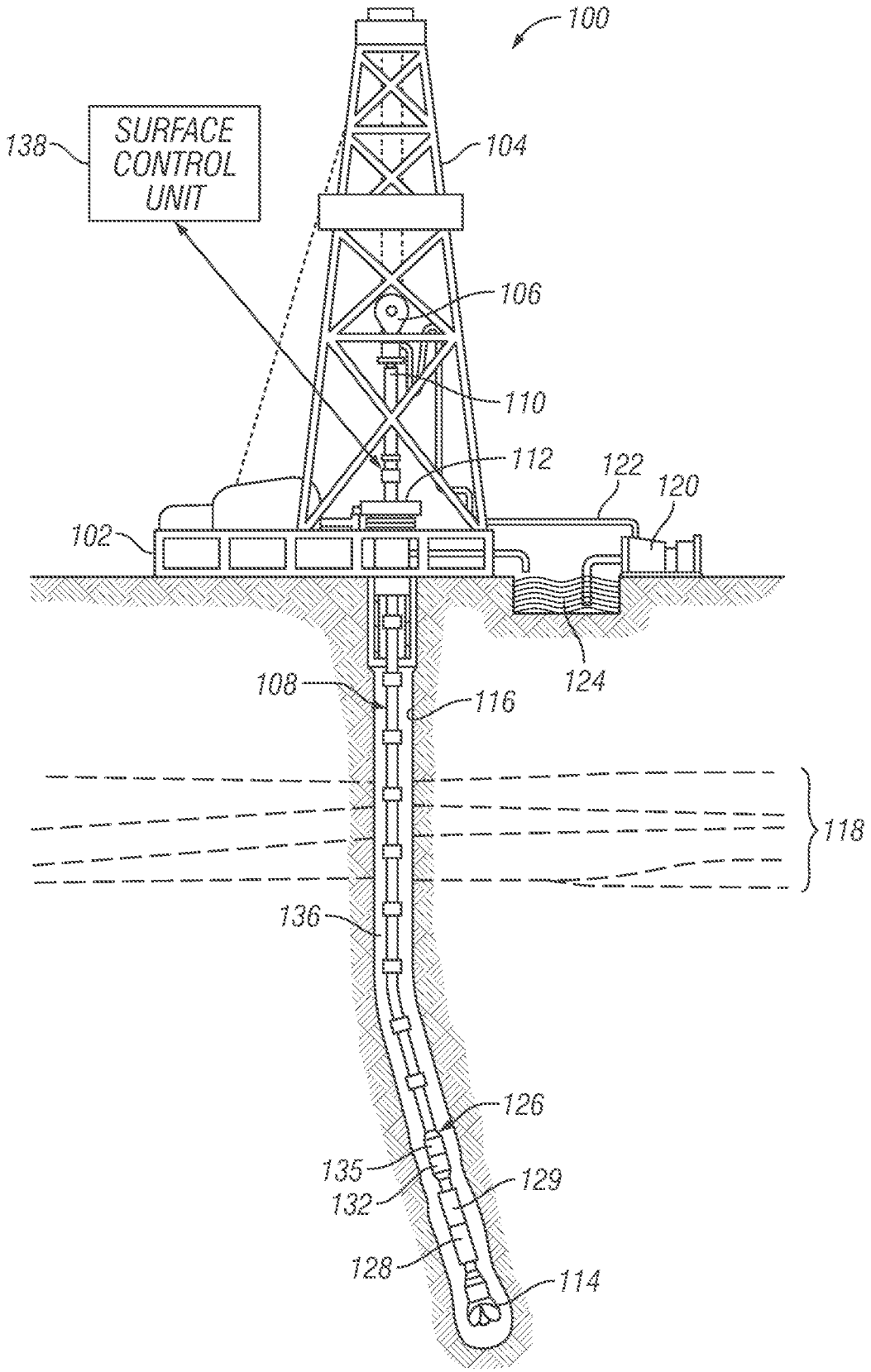
FIG. 1 depicts a schematic view of a directional drilling operation, in accordance with one or more embodiments.

Turning now to the figures, FIG. 1 depicts a schematic view of a drilling operation utilizing a directional drilling system 100, in accordance with one or more embodiments. The system of the present disclosure will be specifically described below such that the system is used to direct a drill bit in drilling a borehole, such as a subsea well or a land well. Further, it will be understood that the present disclosure is not limited to only drilling an oil well. The present disclosure also encompasses natural gas boreholes, other hydrocarbon boreholes, or boreholes in general. Further, the present disclosure may be used for the exploration and formation of geothermal boreholes intended to provide a source of heat energy instead of hydrocarbons.

Accordingly, FIG. 1 shows a tool string 126 disposed in a directional borehole 116. The tool string 126 includes a rotary steerable tool 128 that provides full three dimensional 3D directional control of the drill bit 114. A drilling platform 102 supports a derrick 104 having a traveling block 106 for raising and lowering a drill string 108. A kelly 110 supports the drill string 108 as the drill string 108 is lowered through a rotary table 112. Alternatively, a top drive can be used to rotate the drill string 108 in place of the kelly 110 and the rotary table 112. A drill bit 114 is positioned at the downhole end of the tool string 126 and may be driven by a downhole motor 129 positioned on the tool string 126 and/or by rotation of the entire drill string 108 from the surface. As the bit 114 rotates, the bit 114 forms the borehole 116 that passes through various formations 118. A pump 120 circulates drilling fluid through a feed pipe 122 and downhole through the interior of drill string 108, through orifices in drill bit 114, back to the surface via the annulus 136 around drill string 108, and into a retention pit 124. The drilling fluid transports cuttings from the borehole 116 into the pit 124 and aids in maintaining the integrity of the borehole 116. The drilling fluid may also drive the downhole motor 129.

The tool string 126 may include one or more logging while drilling (LWD) or measurement-while-drilling (MWD) tools 132 that collect measurements relating to various borehole and formation properties as well as the position of the bit 114 and various other drilling conditions as the bit 114 extends the borehole 108 through the formations 118. The LWD/MWD tool 132 may include a device for measuring formation resistivity, a gamma ray device for measuring formation gamma ray intensity, devices for measuring the inclination and azimuth of the tool string 126, pressure sensors for measuring drilling fluid pressure, temperature sensors for measuring borehole temperature, etc.

The tool string 126 may also include a telemetry module 135. The telemetry module 135 receives data provided by the various sensors of the tool string 126 (e.g., sensors of the LWD/MWD tool 132), and transmits the data to a surface unit 138. Data may also be provided by the surface unit 138, received by the telemetry module 135, and transmitted to the tools (e.g., LWD/MWD tool 132, rotary steering tool 128, etc.) of the tool string 126. Mud pulse telemetry, wired drill pipe, acoustic telemetry, or other telemetry technologies known in the art may be used to provide communication between the surface control unit 138 and the telemetry module 135. The surface unit 138 may also communicate directly with the LWD/MWD tool 132 and/or the rotary steering tool 128. The surface unit 138 may be a computer stationed at the well site, a portable electronic device, a remote computer, or distributed between multiple locations and devices. The unit 138 may also be a control unit that controls functions of the equipment of the tool string 126.

The rotary steerable tool 128 is configured to change the direction of the tool string 126 and/or the drill bit 114, such as based on information indicative of tool 128 orientation and a desired drilling direction. The rotary steerable tool 128 is coupled to the drill bit 114 and controls the direction of the drill bit 114. The rotary steerable tool 128 may be either a point-the-bit system or a push-the-bit system.

Figure 2:
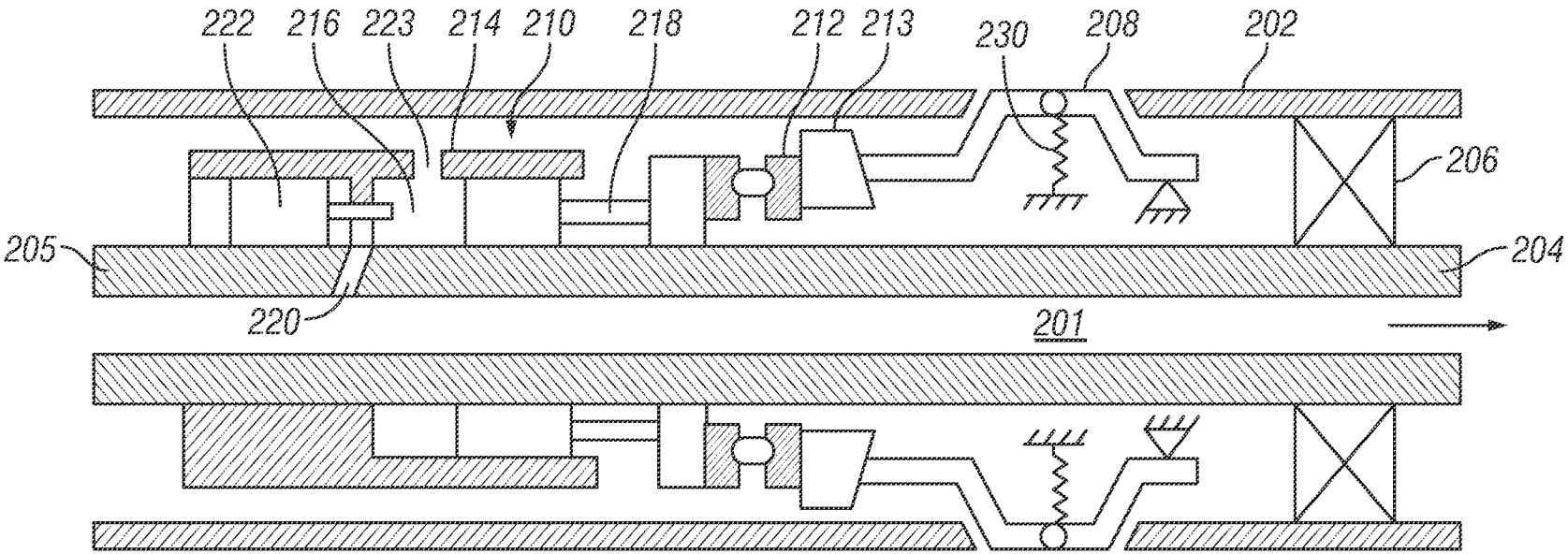
FIG. 2 depicts a cross-sectional schematic view of a mud operated rotary steerable tool, according to an example embodiment of rotary steerable tool.

FIG. 2 depicts a cross-sectional schematic view of a mud operated rotary steerable tool 228, according to one or more embodiments. The tool 228 includes an outer housing 202 and a driveshaft 204 located at least partially within the outer housing 202 and supported by bearings 206 located between the driveshaft and the outer housing 202 for rotation of the driveshaft 204 with respect to the outer housing 202. The bearings 206 may be any type of bearing that facilitates relative motion between the outer housing 202 and the driveshaft 204. The bearings 206 provide a certain amount of friction between the driveshaft 204 and the outer housing 202 such that the driveshaft 204 applies a torque on the outer housing 202 during rotation, rotating the outer housing 202 with the driveshaft 204. Alternatively, seals or a locking device such as splines, detents, and the like, may be used to couple the driveshaft 204 with the housing 202.

The driveshaft 204 is rotatable about an axis of rotation and includes an axial flow bore 201 generally coinciding or aligned with the axis of rotation for transmitting drilling fluid to the drill bit 114 as shown in FIG. 1. Rotation of the driveshaft 204 may be driven by the downhole motor 129 as shown in FIG. 1, such as a mud motor, or by a top drive from the surface.

The tool 228 further includes borehole engagement members 208 radially extendable outwardly from and moveable with the outer housing 202. As shown, each borehole engagement member 208 includes a lever arm, which converts linear motion into an orthogonal outward extension. The borehole engagement members 208 may optionally include a traction member that facilitates stationary contact and friction between the borehole engagement members 208 and the borehole wall. The traction member may include a pad, a textured surface, or any other gripping element(s).

The rotary steerable tool 228 further includes a mud pressure actuation system 210 that controls extension and retraction of the borehole engagement members 208. The mud pressure actuation system 210 includes a piston device 214 mechanically coupled to the borehole engagement members 208 that extends the borehole engagement members 208 upon an increase in hydraulic pressure and allows the borehole engagement members 208 to retract upon a decrease in hydraulic pressure. The borehole engagement members 208 may also be coupled to springs 230 that retract the borehole engagement members 208 upon release of pressure to the piston device 214. Optionally, the outer housing 202 may also include a non-extendable pad (not shown).

The piston device 214 includes a chamber 216 and a piston arm 218. The chamber 216 may be selectively hydraulically coupled to the flow bore 201 via a through port referred to herein as a "mud port" 220 formed in the driveshaft 204. The mud port 220 is a through port in that it passes all the way through a wall 205 of the driveshaft 204, which puts the flow bore 201 of the driveshaft 204 in fluid communication (selectively, as described below) with a portion of the rotary steerable tool 228 external to the driveshaft 204. Thus, drilling fluid, i.e. "mud," may flow through the mud port 220 as further described herein. The mud pressure actuation system 210, in providing selective fluid communication or flow through the mud port 220, also includes a valve 222 that is actuated to selectively open and close the mud port 220. The valve 222 may be a solenoid valve or any other mud valve operated by a suitable actuator including but not limited to electric motors, hydraulic motors, piezoelectric actuators, etc., among others. Power for the valve 222 may be supplied by a power supply, such as a battery, not shown. The valve 222 is located in the mud port 220, adjacent the mud port 220, or in any other position suitable for controlling opening and closing the mud port. The valve 222 may also selectively open and close the mud port 220 to varying degrees. When the mud port 220 is open, the flow bore 201 is in fluid communication with the chamber 216. There may also be a relief port 223 formed on the chamber 216 such that a pressure differential is created, drawing the drilling fluid from the flow bore 201 into the chamber 216 and creating a pressure differential that produces a force on the piston arm 218. The force moves the piston arm 218 axially, producing a force on the borehole engagement member 208 to selectively outwardly extend the borehole engagement members 208. The more open the mud port 220, the larger the pressure applied on the piston arm 218, resulting in more force applied to extend the borehole engagement members 208. Reducing the opening size of the mud port 220, by the same principle, results in reducing the force applied to extend the borehole engagement members 208.

Additionally, an axial cam or cams 213 interacts with the piston arm 218 and the borehole engagement members 208 to control the amount of displacement of the borehole engagement members 208 so that a given displacement of the piston arm 218 may radially extend each borehole engagement member 208 a different amount, or selectively not displace a certain borehole engagement member 208 at all. Thus, the plurality of borehole engagement members 208 may be controlled together or separately. When the tool 228 is downhole, outwardly extending the borehole engagement members 208 may initiate or increase the force applied onto the borehole wall by the borehole engagement member 208, and retracting the borehole engagement member 208 may decrease or remove the force applied onto the borehole wall by the borehole engagement member 208. Further, the borehole engagement members 208 may be coupled to the piston device 214 via a thrust bearing 212 that allows the borehole engagement members 208 to rotate relative to the piston arm 218 and thus the drive shaft.

During a drilling operation, when the borehole engagement members 208 are retracted and not holding the outer housing 202 stationary with respect to the borehole, the outer housing 202 rotates in the same direction as the driveshaft 204. Optionally, the outer housing 202 can also be selectively coupled or locked with the driveshaft 204 to rotate the outer housing 202 with the driveshaft. Certain or all of the borehole engagement members 208 may also be extended to make contact with the borehole wall. When the borehole engagement members 208 are pushed onto the borehole wall with sufficient force, the borehole engagement members 208 restrain the outer housing 202 from rotating with the driveshaft 204. Thus, the outer housing 202 remains stationary while the driveshaft 204 rotates. Furthermore, as explained further below, the axial cam 213 may control the extent to which each borehole engagement member 208 is extended, or whether an borehole engagement member 208 is extended at all. Thus, when the borehole engagement members 208 push against the borehole wall, the tool 228 and drill bit 114 are urged or pushed off-center, causing deviation of the borehole. Thus, a directional well can be formed. The borehole engagement members 208 can be extended and retracted at regular or irregular intervals to control the direction and degree of well segments.

A method of drilling a directional borehole using the tool 228 includes rotating the driveshaft 204 coupled to the drill bit 114 and at least partially located within the outer housing 202. The driveshaft 204 is rotatable with respect to the outer housing 214 via bearings 206 located between the driveshaft 204 and the outer housing 202. The driveshaft 204 may be rotated by a downhole motor 129, such as a mud motor, or by a top drive located at the surface. The method further includes outwardly extending one or more of the borehole engagement members 208, which may include traction members, from the outer housing 202. The borehole engagement members 208 are extended such that one or more borehole engagement members 208 contacts the borehole wall, which pushes the drill bit off-center from the borehole, deviating the borehole, and restrains the outer housing 202 from rotating relative to the borehole wall. Thus, an off-center direction is maintained while the driveshaft 204 rotates the drill bit 114. Extending the borehole engagement members 208 includes applying a hydraulic pressure to the piston device 214 by increasing opening of the mud port 220. The method also includes reducing the opening of the mud port 220, thus allowing the borehole engagement members 208 to retract away from the borehole wall and causing the outer housing 202 to again rotate with the driveshaft. Thus, a particular well can be drilled by controlling extension and retraction of the borehole engagement member 208 to control the direction of the well.

In order to form a straight well section, the borehole engagement members 208 may be extended and retracted at regular intervals such that the borehole engagement members 208 are selectively pushed against the borehole at various angles, constantly deviating the borehole evenly in radially symmetric directions, forming a generally straight section overall. A straight borehole may also be achieved by reducing the pressure on the piston device 214, thus reducing the contact force of the borehole engagement members 208 against the borehole wall. This causes a continuous rotation of the housing, forming a generally straight well section. The borehole engagement members 208 may also be completely retracted, causing the housing 202 to rotate freely with the driveshaft 204, forming a straight well section.

Figure 3A:
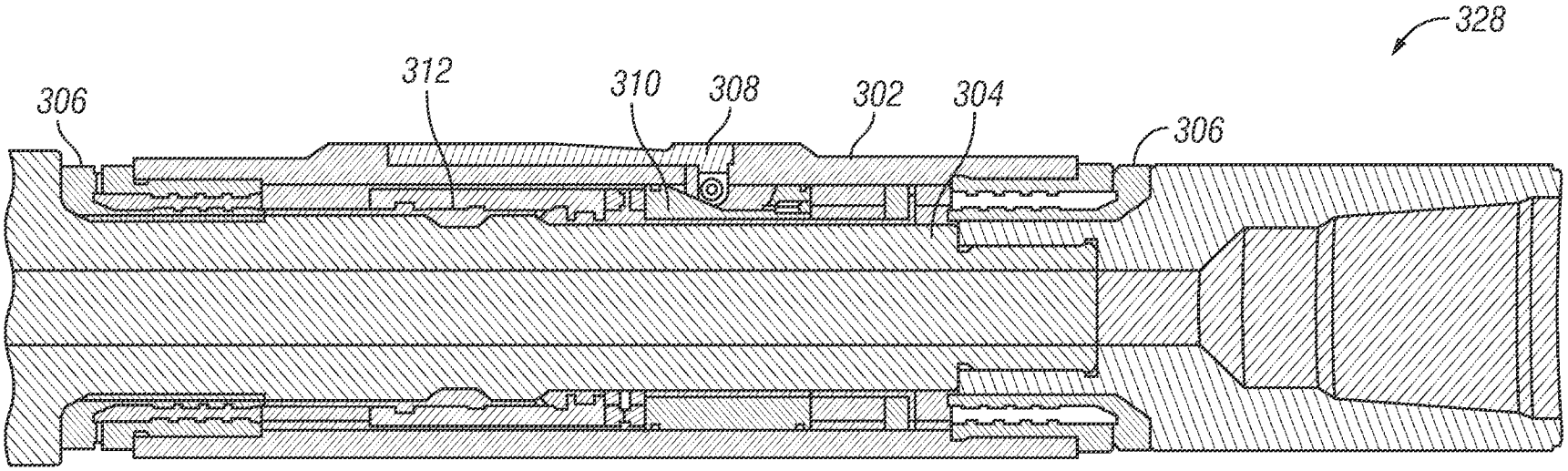
FIGS. 3A and 3B depict a cross-sectional view of a rotary steerable tool, according to another example embodiment.
Figure 3B:
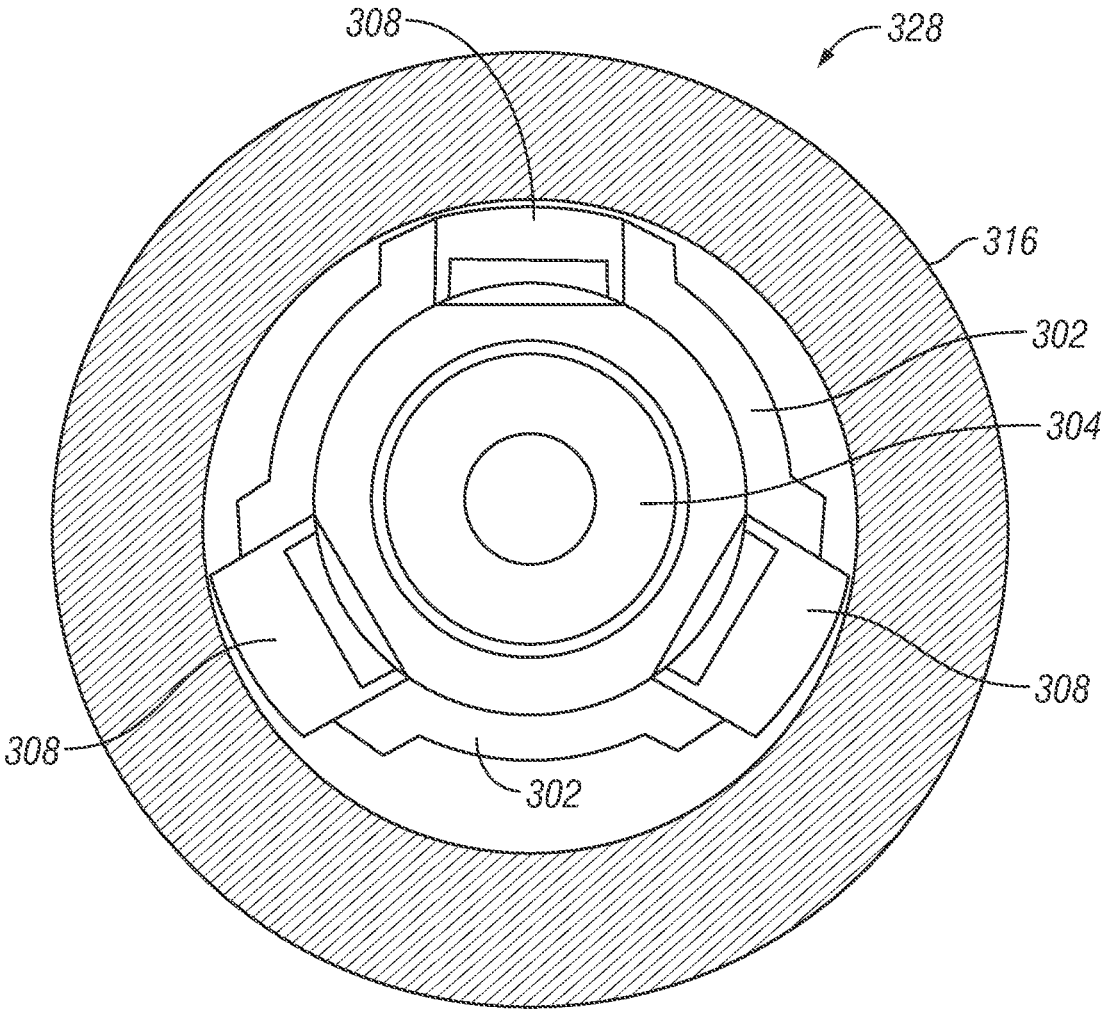

FIGS. 3A and 3B depict a cross-sectional view of a mud operated rotary steerable tool 328, according to one or more embodiments. The tool 328 includes an outer housing 302 and a driveshaft 304 rotatable with respect to the outer housing 302 via bearings 306. The tool 328 further includes one or more borehole engagement members 308 and a cam 310 configured to push the borehole engagement members 308 radially outward from the outer housing 302 when actuated. The cam 310 includes an incline plane that, when pushed forward, extends the borehole engagement member 308 into an extended position. The cam 310 is pushed forward by a piston 312 pressurized by a mud pressure actuation system, similar to that shown in FIG. 2.

As shown, not all of the borehole engagement members 308 must be extended at the same time or to the same extent. With the borehole engagement members 408 extended different amounts or not extended at all, the tool 328 is pushed off-center with respect to the borehole 316. Also, a subset of the borehole engagement members may be extendable further than the remaining borehole engagement member(s), such that when all the borehole engagement members 408 are extended, the tool 328 is pushed off-center with respect to the borehole 316. The rotational orientation of the borehole engagement members 308 also determines the direction of well deviation. The rotational orientation of the borehole engagement members 308 can be changed by retracting the borehole engagement members 308 out of contact with the borehole, which causes the outer housing 302 to rotate along with the driveshaft 304 due to a torque applied on the outer housing 304 by the driveshaft 304 via bearings, seals, or the like. When the desired position is reached, the borehole engagement members 408 are again extended, contacting the borehole 316, and holding the outer housing 402 stationary with respect to the borehole 316. Thus, the well can be formed by controlling the rotational orientation as well as the radial extension of the borehole engagement members 408 during drilling.

Figure 4:
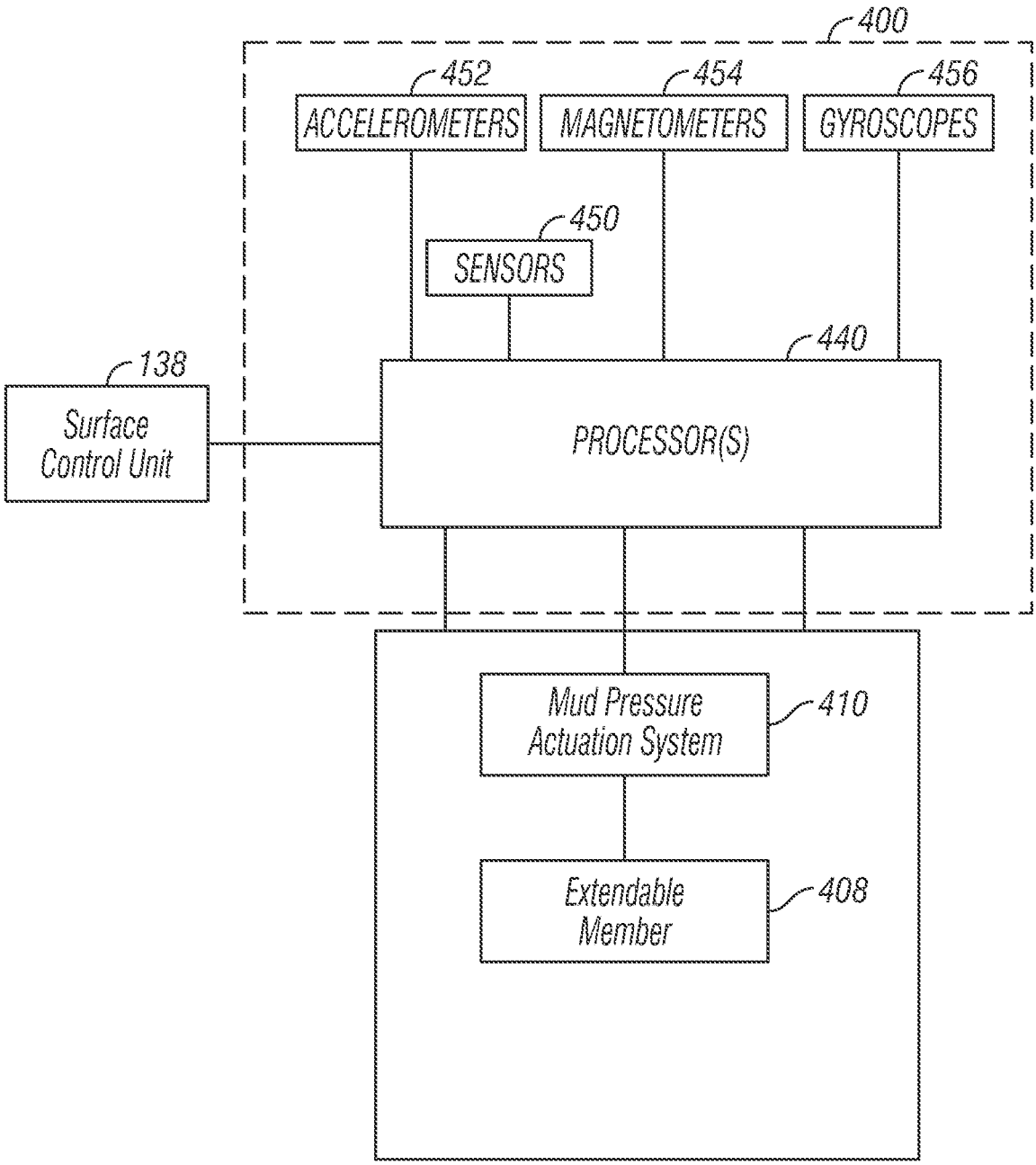
FIG. 4 depicts a block diagram of a control system of a mud operated rotary steerable tool, in accordance with one or more embodiments.

In any of the embodiments of the rotary steerable tool discussed above, the rotary steerable tool may include a control system with sensors and a processor configured to detect positional parameters of the tool and control extension of the borehole engagement members based on a desired drilling direction and/or desired well profile. As an example, FIG. 4 depicts a block diagram of a control system 400, in accordance with one or more embodiments. The control system 400 may be located in outer housing, the driveshaft, or both. The control system 400 includes a processor 440 and a suite of sensors, including directional sensors such as accelerometers 452, magnetometers 454, and gyroscopes 456, and the like for determining a geological position and azimuth or toolface angle of the drill bit 114 to a reference direction (e.g., magnetic north), as well as the position and location of the outer housing. The control system 400 may include any number of these sensors and in any combination. Based on the azimuth and a desired drilling direction or drilling path, the rotary steerable tool determines a suitable control scheme to steer the tool string 126 and drill bit 114 in the desired direction, thereby creating the desired well. The control system 400 receives power from a power source, such as batteries, mud generators, among others. The power supply actually used in a specific application can be chosen based on performance requirements and available resources.

The control system 400 utilizes the sensors to maintain a geographic reference for steering control of the rotary steerable tool. The control system 400 may also include various other sensors 450 such as temperature sensors, magnetic field sensors, and rpm sensors, among others. The sensors are coupled to the processor 440. The sensors may be embedded anywhere on the rotary steerable tool and may take respective measurements and transmit the measurements to the processor 440 in real time.

The processor 440 is configured to control the mud pressure actuation system 410 which controls extension and retraction of the borehole engagement member(s) 408. For example, in the embodiment of the rotary steerable tool 228 shown in FIG. 2, the processor 440 sends control signals to the valve 222 to control opening and closing of the mud port 220. The profile of the drilling operation may include information such as the location of the drilling target, type of formation, and other parameters regarding the specific drilling operation. As the tool rotates, the sensors (e.g., accelerometers 452, magnetometers 454, and gyroscopes 456) send measurements to the processor 440. The processor 440 uses the measurements to track the position of the tool with respect to the target drilling direction, for example, in real time. The processor 440 may thus determine which direction to direct the drill bit 114 and when to extend and retract the borehole engagement members 408. For example, when the borehole engagement members are retracted, the outer housing rotates with respect to the borehole. When the outer housing rotates into the desired position, which is associated with the desired drilling direction, the borehole engagement members are extended to hold the outer housing stationary with respect to the borehole.

Since the location of the borehole engagement members 408 is fixed with respect to the outer housing, the location of the borehole engagement members can be derived from the location of the outer housing. The processor 440 can then determine when to actuate the borehole engagement members in order to direct the drill bit 114 in the desired direction. The borehole engagement members can be actuated at any time interval for full three dimensional control of the direction of the drill bit 114. The directional control may be relative to gravity toolface, magnetic toolface, or gyro toolface.

For example, if the drill bit 114 needs to be directed towards high side (0 degree toolface angle), then an borehole engagement member is extended and made stationary against the borehole at the 180 degree location of the tool. This pushes the drill bit 114 in a radial direction off center with respect to the borehole and the borehole is drilled at the respective angle/direction. When the drilling angle needs to be changed, the borehole engagement member 408 is retracted and released from the borehole wall.

The processor 440 may also be in communication with the surface control unit 138. The surface control unit 138 may thus send instructions or information to the processor 440 such as the information related to the profile of the drilling operation such as location of the drilling target, rate of direction change, and the like. For example, the surface control unit 138 may receive control commands from an operator that are relayed to the control system 400. The surface control unit 138 may also send preprogrammed commands to the control system 400 set according to the profile of the drilling operation.

In addition to the embodiments described above, many examples of specific combinations are within the scope of the disclosure, some of which are detailed below:

Example 1

A directional drilling device for drilling a borehole having a borehole wall, the directional drilling device comprising: an outer housing; a driveshaft located at least partially within and selectively rotatable with respect to the housing, the driveshaft comprising a driveshaft wall defining an axial flow bore and a through port formed in the driveshaft wall; one or more borehole engagement members rotatable with and also radially moveable with respect to the outer housing toward engagement with the borehole wall to urge the directional drilling device in a radial direction with respect to the borehole; a mud pressure actuation system comprising a piston device selectively hydraulically coupled to the axial flow bore via the through port and mechanically coupled to the borehole engagement members; and wherein the mud pressure actuation system is configured to control fluid flow through the through port to control hydraulic pressure on the piston device and thus movement of the borehole engagement members into engagement with the borehole wall to maintain a rotational position of the outer housing and the corresponding radial direction in which the device is being urged.

Example 2

The device of example 1, wherein the borehole engagement members are extendable in unison.

Example 3

The device of example 1, wherein the mud pressure actuation system further comprises a valve, the piston device comprises a piston arm and a chamber selectively hydraulically coupled to the axial flow bore via the through port via actuation of the valve, and the piston arm is mechanically coupled to the borehole engagement members so as to move the borehole engagement members upon an increase in pressure in the chamber.

Example 4

The device of example 3, wherein the borehole engagement members are retractable upon a decrease in pressure in the chamber.

Example 5

The device of example 3, further comprising a cam that interactable with the piston arm and the borehole engagement members to control the amount of displacement of the borehole engagement members so that a given displacement of the piston arm extends each borehole engagement member a different amount or not at all.

Example 6

The device of example 1, further comprising a bearing rotatably supporting the driveshaft within the outer housing with an amount of friction so as to apply a torque from the driveshaft to the outer housing during rotation of the driveshaft.

Example 7

The device of example 6, wherein the outer housing is rotatable by the driveshaft with the borehole engagement members not contacting the borehole wall.

Example 8

The device of example 1, further comprising sensors to measure one or more positional parameters of the outer housing and the borehole engagement members.

Example 9

The device of example 1, further comprising a control system comprising a processor to control actuation of the mud pressure actuation system and thus extension of the borehole engagement members.

Example 10

A directional drilling system for drilling a directional borehole having a borehole wall, comprising: an outer housing; a driveshaft located at least partially within and selectively rotatable with respect to the outer housing, the driveshaft comprising a driveshaft wall defining an axial flow bore and a through port formed in the driveshaft wall hydraulically coupling the axial flow bore to outside the driveshaft; a drill bit rotatable by the driveshaft; one or more borehole engagement members rotatable with and also radially moveable with respect to the outer housing toward engagement with the borehole wall to urge the directional drilling device in a radial direction with respect to the borehole; a mud pressure actuation system comprising rotatable with and also radially moveable with respect to the outer housing toward engagement with the borehole wall to urge the directional drilling device in a radial direction with respect to the borehole; a control system, comprising a sensor to monitor the position of the borehole engagement members and a processor to control extension of the borehole engagement members via the mud pressure actuation system; and wherein the mud pressure actuation system is configured to control fluid flow through the through port to control hydraulic pressure on the piston device and thus movement of the borehole engagement members into engagement with the borehole wall to maintain a rotational position of the outer housing and the corresponding radial direction in which the device is being urged.

Example 11

The directional drilling system of example 10, wherein the control system comprises an accelerometer, a magnetometer, a gyroscope, or any combination thereof.

Example 12

The directional drilling system of example 10, wherein the mud pressure actuation system further comprises a valve, the piston device comprises a piston arm and a chamber selectively hydraulically coupled to the flow bore via the through port via actuation of the valve, and the piston arm is mechanically coupled to the borehole engagement member so as to move the borehole engagement member upon an increase in pressure in the chamber.

Example 13

The directional drilling system of example 10, wherein the control system is communicably coupled to a surface control center.

Example 14

The directional drilling system of example 10, wherein a toolface of the drill bit is controlled by increasing and decreasing the force applied by the borehole engagement members to the borehole wall.

Example 15

A method of drilling a directional borehole having a wall, comprising: rotating an outer housing of a drilling device to a first rotational orientation relative to the borehole via rotation of a driveshaft; radially outwardly extending borehole engagement members from the outer housing into engagement with the borehole wall, thereby restraining the outer housing from rotating with the driveshaft and urging the drill bit in a radial direction with respect to the borehole; and drilling the borehole in the radial direction to deviate the borehole.

Example 16

The method of example 15, further comprising: allowing the borehole engagement members to retract and decrease engagement with the borehole wall, thereby allowing the outer housing to rotate with the driveshaft; rotating the outer housing to a second rotational orientation via rotation of the driveshaft; radially outwardly extending the borehole engagement members from the outer housing into engagement with the borehole wall, thereby restraining the outer housing from rotating with the driveshaft and urging the drill bit in a second radial direction with respect to the borehole; and drilling the borehole in the second radial direction to deviate the borehole.

Example 17

The method of example 16, further comprising radially extending and allowing the borehole engagement members to retract at regular intervals.

Example 18

The method of example 16, further comprising drilling a straight borehole section.

Example 19

The method of example 15, wherein the borehole engagement members are extended by increasing an openness of a through port in the driveshaft to increase flow of a drilling fluid into a chamber of a piston device, thus increasing pressure applied to a piston arm coupled to the borehole engagement members.

Example 20

The method of example 15, further comprising rotating the driveshaft with respect to the outer housing upon engagement of the borehole engagement members with the borehole wall.

Example 21

The method of example 15, further comprising rotating the outer housing with the driveshaft upon retraction of the borehole engagement members from the borehole wall.

This discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to intimate that the scope of the disclosure, including the claims, is limited to that embodiment.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present invention has been described with respect to specific details, it is not intended that such details should be regarded as limitations on the scope of the invention, except to the extent that they are included in the accompanying claims.

What is claimed is:

1. A directional drilling device for drilling a borehole having a borehole wall, the directional drilling device comprising:

an outer housing;

a driveshaft located at least partially within and selectively rotatable with respect to the housing, the driveshaft comprising a driveshaft wall defining an axial flow bore and a through port formed in the driveshaft wall;

one or more borehole engagement members rotatable with and also radially moveable with respect to the outer housing toward engagement with the borehole wall to urge the directional drilling device in a radial direction with respect to the borehole;

a mud pressure actuation system comprising a piston device selectively hydraulically coupled to the axial flow bore via the through port and mechanically coupled to the borehole engagement members; and wherein the mud pressure actuation system is configured to control fluid flow through the through port to control hydraulic pressure on the piston device and thus movement of the borehole engagement members into engagement with the borehole wall to maintain a rotational position of the outer housing and the corresponding radial direction in which the device is being urged.

2. The device of claim 1, wherein the borehole engagement members are extendable in unison.

3. The device of claim 1, wherein the mud pressure actuation system further comprises a valve, the piston device comprises a piston arm and a chamber selectively hydraulically coupled to the axial flow bore via the through port via actuation of the valve, and the piston arm is mechanically coupled to the borehole engagement members so as to move the borehole engagement members upon an increase in pressure in the chamber.

4. The device of claim 3, wherein the borehole engagement members are retractable upon a decrease in pressure in the chamber.

5. The device of claim 3, further comprising a cam that interactable with the piston arm and the borehole engagement members to control the amount of displacement of the borehole engagement members so that a given displacement of the piston arm extends each borehole engagement member a different amount or not at all.

6. The device of claim 1, further comprising a bearing rotatably supporting the driveshaft within the outer housing with an amount of friction so as to apply a torque from the driveshaft to the outer housing during rotation of the driveshaft.

7. The device of claim 6, wherein the outer housing is rotatable by the driveshaft with the borehole engagement members not contacting the borehole wall.

8. The device of claim 1, further comprising sensors to measure one or more positional parameters of the outer housing and the borehole engagement members.

9. The device of claim 1, further comprising a control system comprising a processor to control actuation of the mud pressure actuation system and thus extension of the borehole engagement members.

10. A directional drilling system for drilling a directional borehole having a borehole wall, comprising:

an outer housing;

a driveshaft located at least partially within and selectively rotatable with respect to the outer housing, the driveshaft comprising a driveshaft wall defining an axial flow bore and a through port formed in the driveshaft wall hydraulically coupling the axial flow bore to outside the driveshaft;

a drill bit rotatable by the driveshaft;

one or more borehole engagement members rotatable with and also radially moveable with respect to the outer housing toward engagement with the borehole wall to urge the directional drilling device in a radial direction with respect to the borehole;

a mud pressure actuation system comprising rotatable with and also radially moveable with respect to the outer housing toward engagement with the borehole wall to urge the directional drilling device in a radial direction with respect to the borehole;

a control system, comprising a sensor to monitor the position of the borehole engagement members and a processor to control extension of the borehole engagement members via the mud pressure actuation system; and wherein the mud pressure actuation system is configured to control fluid flow through the through port to control hydraulic pressure on the piston device and thus movement of the borehole engagement members into engagement with the borehole wall to maintain a rotational position of the outer housing and the corresponding radial direction in which the device is being urged.

11. The directional drilling system of claim 10, wherein the control system comprises an accelerometer, a magnetometer, a gyroscope, or any combination thereof.

12. The directional drilling system of claim 10, wherein the mud pressure actuation system further comprises a valve, the piston device comprises a piston arm and a chamber selectively hydraulically coupled to the flow bore via the through port via actuation of the valve, and the piston arm is mechanically coupled to the borehole engagement member so as to move the borehole engagement member upon an increase in pressure in the chamber.

13. The directional drilling system of claim 10, wherein the control system is communicably coupled to a surface control center.

14. The directional drilling system of claim 10, wherein a toolface of the drill bit is controlled by increasing and decreasing the force applied by the borehole engagement members to the borehole wall.

15. A method of drilling a directional borehole having a wall, comprising:

rotating an outer housing of a drilling device to a first rotational orientation relative to the borehole via rotation of a driveshaft;

increasing an openness of a through port in the driveshaft to increase flow of a drilling fluid into a chamber of a piston device, thus increasing pressure applied to a piston arm coupled to the borehole engagement members to radially outwardly extend borehole engagement members from the outer housing into engagement with the borehole wall, thereby restraining the outer housing from rotating with the driveshaft and urging the drill bit in a radial direction with respect to the borehole; and drilling the borehole in the radial direction to deviate the borehole.

16. The method of claim 15, further comprising:

allowing the borehole engagement members to retract and decrease engagement with the borehole wall, thereby allowing the outer housing to rotate with the driveshaft;

rotating the outer housing to a second rotational orientation via rotation of the driveshaft;

radially outwardly extending the borehole engagement members from the outer housing into engagement with the borehole wall, thereby restraining the outer housing from rotating with the driveshaft and urging the drill bit in a second radial direction with respect to the borehole; and drilling the borehole in the second radial direction to deviate the borehole.

17. The method of claim 16, further comprising radially extending and allowing the borehole engagement members to retract at regular intervals.

18. The method of claim 16, further comprising drilling a straight borehole section.

19. The method of claim 15, further comprising rotating the driveshaft with respect to the outer housing upon engagement of the borehole engagement members with the borehole wall.

20. The method of claim 15, further comprising rotating the outer housing with the driveshaft upon retraction of the borehole engagement members from the borehole wall.

* * * * *